US011026501B1

(12) United States Patent
Dabrowka

(10) Patent No.: US 11,026,501 B1
(45) Date of Patent: Jun. 8, 2021

(54) BACKPACK WITH RAPID-DEPLOY FRONT BALLISTIC CARRIER

(71) Applicant: ACE LINK INDUSTRIAL, INC., Irvine, CA (US)

(72) Inventor: Jakub Aleksander Dabrowka, Irvine, CA (US)

(73) Assignee: ACE LINK INDUSTRIAL, INC., Irvine, CA (US)

( * ) Notice: Subject to any disclaimer, the term of this patent is extended or adjusted under 35 U.S.C. 154(b) by 36 days.

(21) Appl. No.: 16/732,148

(22) Filed: Dec. 31, 2019

(51) Int. Cl.

| | |
|---|---|
| ***A45F 4/02*** | (2006.01) |
| ***F41H 1/02*** | (2006.01) |
| ***F41H 5/08*** | (2006.01) |
| ***A45F 3/06*** | (2006.01) |

(52) U.S. Cl.
CPC ..... *A45F 4/02* (2013.01); *A45F 3/06* (2013.01); *F41H 1/02* (2013.01); *F41H 5/08* (2013.01)

(58) Field of Classification Search
CPC ..... A45F 2003/045; A45F 3/06; A45F 4/02; A45F 2003/003; A45F 2003/144; A45F 3/04; F41H 5/08; F41H 5/013; F41H 1/02
USPC ..... 224/576
See application file for complete search history.

(56) References Cited

U.S. PATENT DOCUMENTS

| | | | | |
|---|---|---|---|---|
| 6,161,738 | A | 12/2000 | Norris | |
| 9,801,452 | B2 | 10/2017 | Duthoit | |
| 10,130,160 | B1 * | 11/2018 | Cheng | A45F 3/06 |
| 10,188,197 | B2 | 1/2019 | Fraile Nuez | |
| 10,213,008 | B2 | 2/2019 | Weaver, Jr. et al. | |
| 10,555,596 | B2 * | 2/2020 | de Geus | A45F 3/04 |
| 2011/0097021 | A1 | 4/2011 | Curran et al. | |
| 2017/0099933 | A1 | 4/2017 | Drake | |
| 2017/0276457 | A1 | 9/2017 | Chapman | |
| 2017/0332768 | A1 * | 11/2017 | Fraile Nuez | A45F 3/06 |
| 2018/0317635 | A1 | 11/2018 | Quon-Chow et al. | |
| 2020/0025523 | A1 * | 1/2020 | Ross | F41H 1/02 |

FOREIGN PATENT DOCUMENTS

| | | | | |
|---|---|---|---|---|
| GB | 2569152 A | * | 6/2019 | |
| WO | WO-2019144028 A1 | * | 7/2019 | F41H 5/08 |

* cited by examiner

*Primary Examiner* — Nathan J Newhouse
*Assistant Examiner* — Matthew T Theis
(74) *Attorney, Agent, or Firm* — Vista IP Law Group LLP

(57) ABSTRACT

A backpack (10) with a rapid-deploy front ballistic carrier (26) removably securable in a compartment (16) with an open top (22). The carrier (26) has shoulder straps (28) attached to a wall of the compartment (16) inside the compartment (16), and a handle (34) of the carrier (26) is configured to be exposed through the open top (22) when the carrier (26) is removably secured in the compartment (16), thus being accessible to the person wearing the backpack (10). The carrier (26) is removably secured in the compartment (16) by a retention system that includes a ripcord (42) (with a pull tab (50)) threaded through a) a channel (52) along a length of one of the backpack's shoulder harnesses (24), b) an opening (58) in a wall of the compartment (16), and c) a plurality of sealing eyelets (60) positioned adjacent the open top (22), and is then removably secured/anchored in an anchor eyelet (62) in the compartment (16).

20 Claims, 13 Drawing Sheets

BACKPACK WITH RAPID-DEPLOY FRONT BALLISTIC CARRIER

TERMINOLOGY

"Hook and loop" as used herein means traditional hook and loop such as VELCRO, as well as other similar touch fasteners such as 3M's DUAL LOCK fasteners.

"Front" and "back" are used relative to a person's body when wearing a backpack, such that the front of the backpack is the side facing frontward (i.e., the side that rests against the person's back) and the back of the backpack is the side facing backward (i.e., the opposite side of the backpack).

"L" and "R" are appended onto reference numbers to signify Left and Right respectively when a specific Left or Right component is being referenced. A reference number used without L or R refers to a component without regard to whether the component has a Left or Right counterpart. For example, "24R" refers to the right shoulder harness of the backpack, and "24L" refers to the left shoulder harness of the backpack, whereas "24" refers simply to any shoulder harness on the backpack.

FIELD OF THE INVENTION

The invention relates generally to backpacks with a ballistic carrier, and more particularly to backpacks with a deployable front ballistic carrier.

BACKGROUND

Situations exist in which a person wearing a backpack in an otherwise friendly environment may all of a sudden need front body armor to protect against possible threats. For example, law enforcement or military personnel may be operating in a state of low alert that unexpectedly and quickly turns hostile. Likewise, people anywhere in the general public may be going about their business when all of a sudden an active shooter situation emerges. While back body armor may be carried effectively inside a backpack, the ability to quickly and effectively deploy front body armor from the backpack is not as common. Of course, wearing the front body armor in the first instance would prevent the need for rapid deployment from a backpack, but oftentimes that is not ideal due to its visible presence and/or the loss of physical range of mobility caused thereby. For example: a law enforcement officer might be working undercover; military personnel may be on a routine patrol in friendly territory; a student may be walking across a school campus; a person may be shopping at a mall; etc.

Some backpacks have been disclosed having both front and back body armor. See, e.g.: U.S. Pat. No. 6,161,738 (Norris) issued Dec. 19, 2000; U.S. Pat. No. 9,801,452 (Duthoit) issued Oct. 31, 2017; U.S. Pat. No. 10,188,197 (Nuez et al.) issued Jan. 29, 2019; U.S. Pat. No. 10,213,008 (Weaver, Jr. et al.) issued Feb. 26, 2019; U.S. Patent Publication No. 2011/0097021 (Curran et al.) published Apr. 28, 2011; U.S. Patent Publication No. 2017/0099933 (Drake) published Apr. 13, 2017; U.S. Patent Publication No. 2017/0276457 (Chapman) published Sep. 28, 2017; and U.S. Patent Publication No. 2018/0317635 (Quon-Chow et al.) published Nov. 8, 2018. However, none of the aforementioned references disclose a backpack having a compartment with an open top housing a deployable front ballistic carrier with right and left shoulder straps and a handle, configured to be removably secured in the compartment by a retention system such that the handle is exposed through the open top, wherein the retention system comprises a ripcord having a cord threaded through a) a channel along a length of one of the backpack's shoulder harnesses, b) an opening in a wall of the compartment, and c) a plurality of sealing eyelets positioned adjacent the open top, with the ripcord then removably secured/anchored in an anchor eyelet in the compartment. The ripcord also has a pull tab. In this manner, the ripcord removably secures the deployable front ballistic carrier in the compartment by partially obstructing the open top. Further, the pull tab is exposed adjacent the channel on the shoulder harness, and can be pulled to disengage the ripcord from the anchor eyelet and the sealing eyelets such that the open top becomes unobstructed. As such, the carrier handle may be pulled to remove the carrier (presumably with ballistic armor contained therein) from the compartment, and then deploy the carrier over the head of the person wearing the backpack such that the right and left shoulder straps rest over the person's shoulders and the carrier rests against the person's chest.

SUMMARY OF THE INVENTION

In some aspects of the present invention, a backpack has: a) a first compartment (12) (sometimes referred to herein as a "main compartment"; b) a second compartment (16) (sometimes referred to herein as simply "compartment") with an open top; c) right and left shoulder harnesses; and d) a deployable ballistic carrier having a handle, a body, and right and left shoulder straps attached at one end to the body and at the other end to one of the walls of the second compartment inside the second compartment. The carrier can be removably secured in the second compartment by a retention system, leaving the carrier handle exposed through the open top. The retention system includes: a) a ripcord with a pull tab at the proximal end; b) a channel along a length of one of the backpack's shoulder harnesses; c) an opening in a wall of the second compartment; d) sealing eyelets positioned adjacent the open top; and e) an anchor eyelet in the second compartment at a side of the backpack opposite the channel. A portion of the ripcord can be threaded through the channel, the wall opening, and the sealing eyelets such that the pull tab abuts up against and remains outside the channel, and the distal end of the ripcord can then be removably anchored in the anchor eyelet. This partially obstructs the open top, and thus removably secures the carrier in the second compartment with the carrier handle still exposed.

As such, when the ripcord pull tab is pulled, the ripcord disengages from the rest of the retention system such that the open top becomes unobstructed. The exposed carrier handle may then be accessed and pulled to gain control of the carrier which can then be swung over the person's head such that the carrier's shoulder straps rest over the person's shoulders and rests against the person's chest. In one aspect of the present invention, the carrier handle is removably secured to one of the backpack's shoulder harnesses for easy access.

These aspects are described in more detail herein. Also, other aspects, embodiments, and details of the present invention are described herein. For example, a fixed ballistic armor may be removably secured in the main compartment to cover the back area. The retention system may be ambidextrous by including channels, wall openings, and anchor eyelets on both sides of the backpack, along with other features described herein. The sealing eyelets may be on flaps. The backpack may include a waist strap, a chest strap, additional compartments, other ballistic carriers, other ballistic armor, and/or other features. The carrier handle may include a fixed portion and an adjustable portion, and the adjustable portion may be a strap slidingly engaged to and extending outwardly from the fixed portion to enable positioning over the person's left or right shoulder as desired.

The present invention thus provides a backpack with a rapid-deploy front ballistic carrier that can be stored inconspicuously in a compartment with an open top.

DRAWINGS

DETAILED DESCRIPTION

Figure 6:
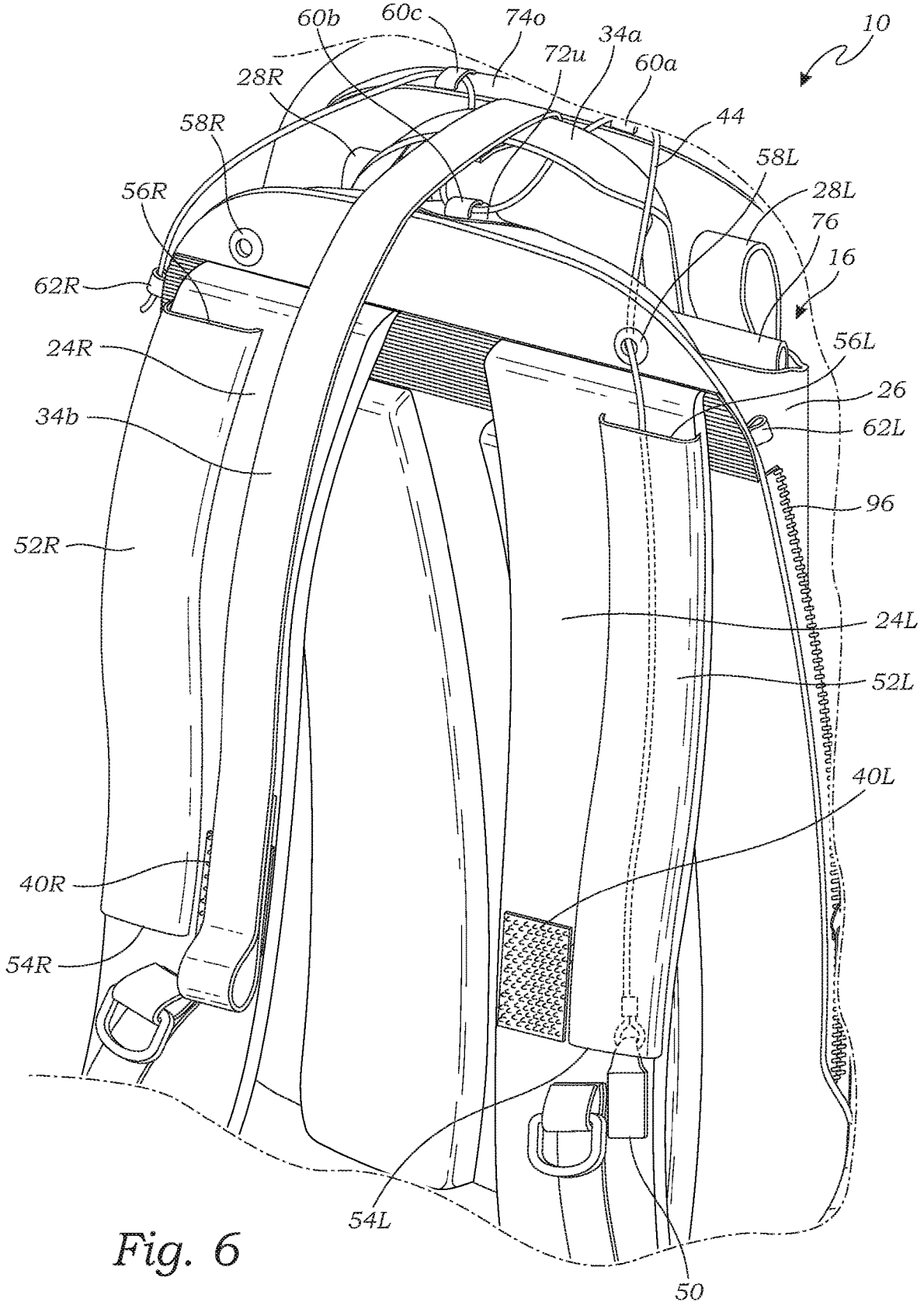
FIG. 6 shows the backpack (10) of FIG. 1 with a ripcord (42) threaded (in partial phantom) but not tightened, and front flap (72) flipped back for illustration.

Preferred embodiments of the invention will now be described. The invention relates to a backpack (10) having a) a compartment (16) with an open top (22); and b) a rapid-deploy front ballistic carrier (26) removably securable in the compartment (16). Carrier (26) has left and right shoulder straps (28L) and (28R) attached to a wall (18) of the compartment (16) inside the compartment (16). A handle (34) of carrier (26) is exposed through open top (22) when carrier (26) is removably secured in compartment (16), thus being accessible to a person wearing backpack (10). Carrier (26) is removably secured in compartment (16) by a retention system that includes a ripcord (42) and a sealing path. Ripcord (42) has a cord (44) and a pull tab (50). Cord (44) is threaded through the sealing path, namely: a) a channel (52) along a length of one of the backpack's shoulder harnesses (24); b) an opening (58) in a wall (18) of compartment (16); and c) a plurality of sealing eyelets (60) positioned adjacent open top (22), all as best seen in FIG. 6. Cord (44) is then removably secured in anchor eyelet (62) in compartment (16). This is described in more detail herein.

Figure 1:
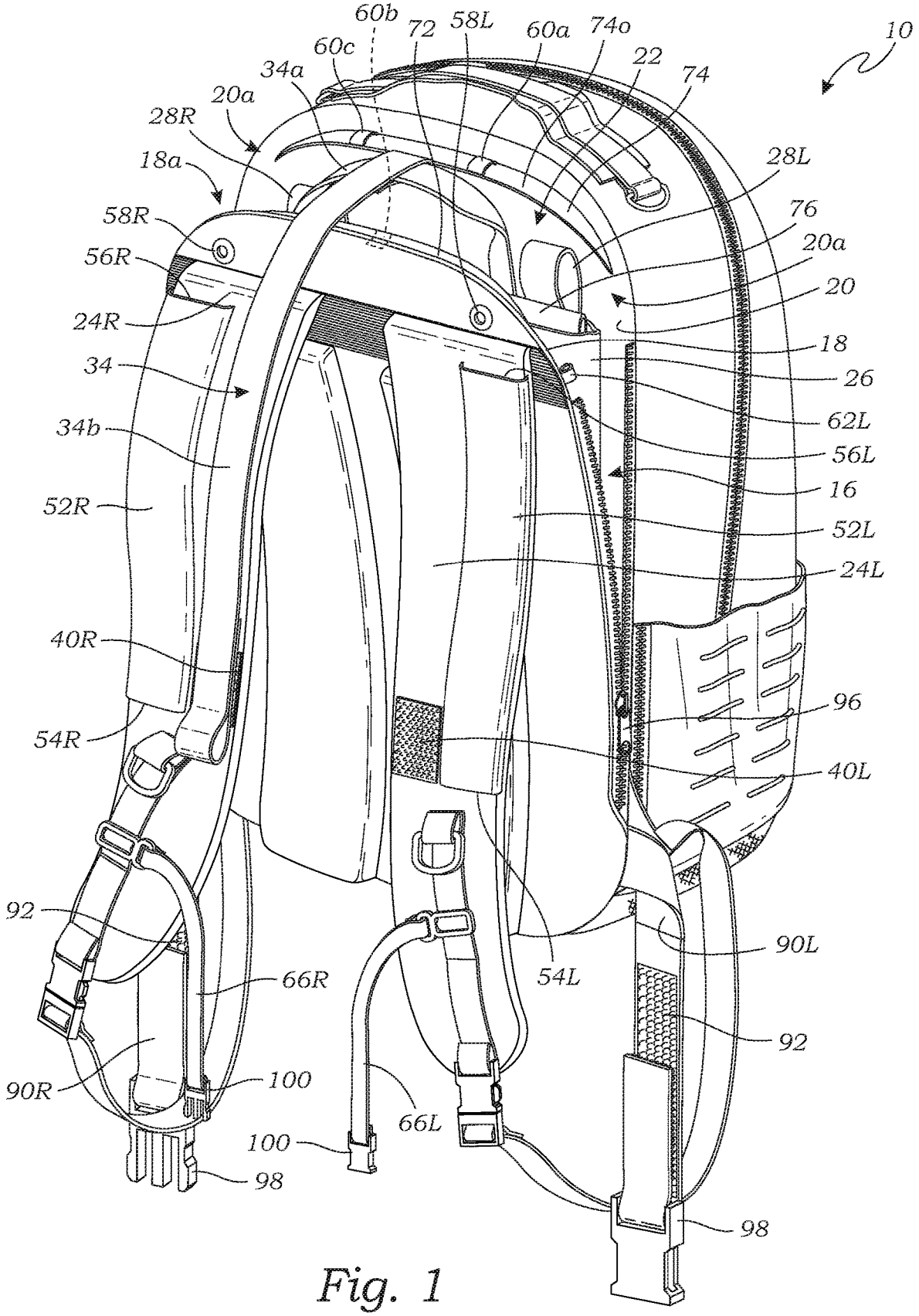
FIG. 1 shows a side front perspective view of a backpack (10) in accordance with an embodiment of the present invention, with a deployable front carrier (26) contained in a compartment (16) having an open top (22).
Figure 2:
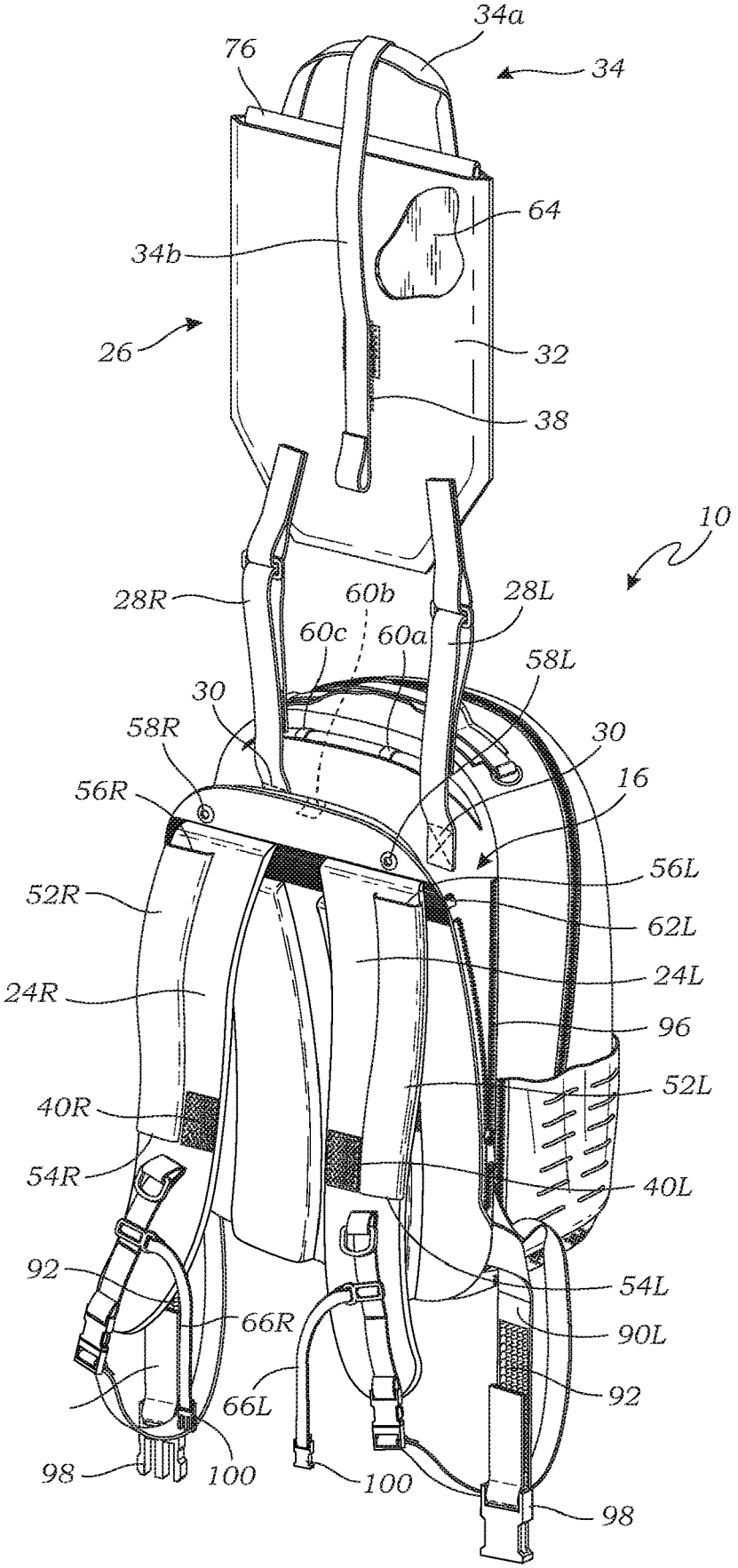
FIG. 2 shows the backpack (10) of FIG. 1, with the deployable front carrier (26) removed from the compartment (16) and a partial cutaway to show the front ballistic armor (64).
Figure 3:
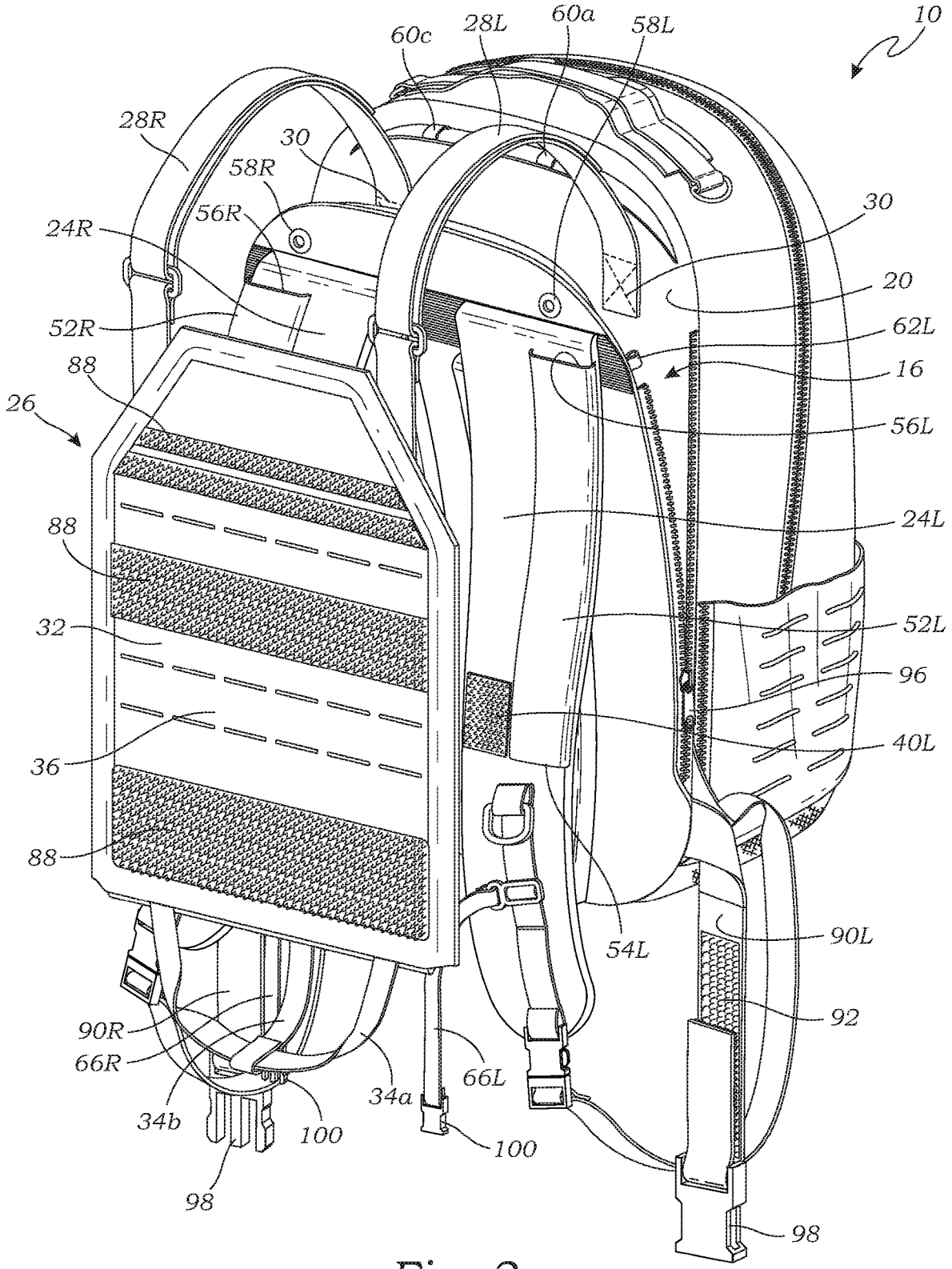
FIG. 3 shows the backpack (10) of FIG. 2, with the carrier (26) oriented to cover the chest area of a person wearing the backpack (10).
Figure 4:
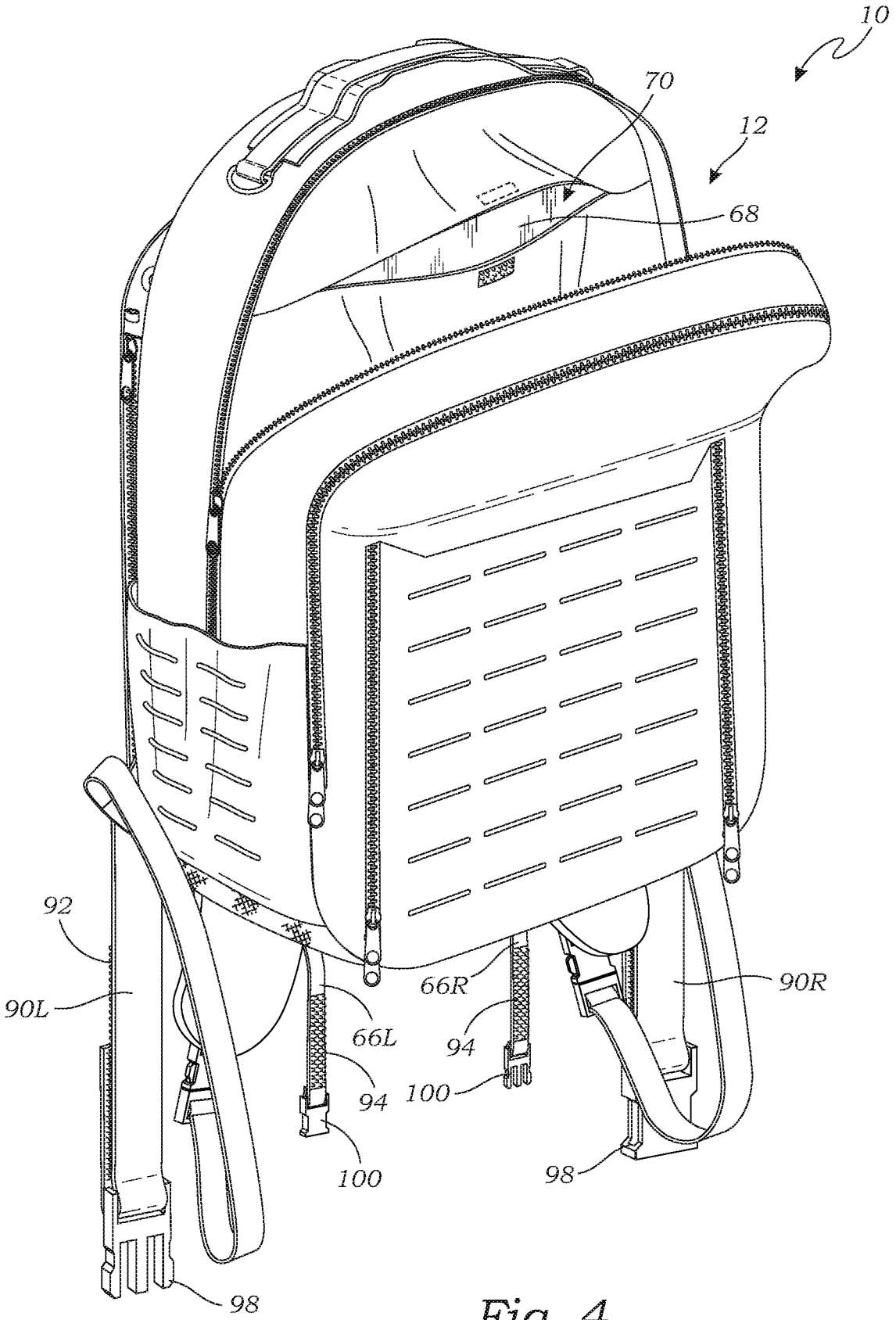
FIG. 4 shows a side back perspective view of the backpack (10) of FIG. 1, with the main compartment (12) open.

Turing now to FIGS. 1-4, a backpack (10) in accordance with an embodiment of the present invention is shown. Backpack (10) has left and right shoulder harnesses (24L) and (24R) respectively, waist strap (90), and chest strap (66). In FIG. 1 and FIG. 4, deployable front carrier (26) is shown removably secured in compartment (16). FIGS. 2-3 show front carrier (26) removed from compartment (16), with FIG. 3 showing front carrier (26) positioned as if fully-deployed on a person.

Backpack has main compartment (12) for storage of typical cargo such as books, clothes, hiking equipment, food, tactical gear, etc. Main compartment (12) (or other compartment) may also include sleeve (70) or other storage means for storing fixed ballistic armor (68), such that when deployable front ballistic carrier (26) is deployed (with ballistic armor (64) therein) as described herein, the person wearing backpack (10) will have protection both in the front (by ballistic armor (64)) and back (by ballistic armor (68)) similar to a ballistic vest.

Compartment (16) has front wall (18) at front side (18*a*) thereof, and back wall (20) at back side (20*a*) thereof. Front wall (18) has at least one opening (58) to receive distal end (48) of cord (44) and guide a length of cord (44) thereafter as described herein. Typically opening (58) is adjacent exit point (56) of channel (52). Opening (58) may be circular and reinforced with a metal or plastic ring such as a grommet. In some embodiments, there are two openings (58L) and (58R) adjacent exit points (56L) and (56R) respectively to allow ripcord (42) to be threaded from left to right or right to left as described herein. Compartment (16) has an open top (22). In other words, there is no zipper, hook and loop fastening system, or other integrated feature to seal off the open top (22). Instead, when backpack (10) is prepared for use, a retention system including ripcord (42) threaded through a sealing path is used to partially obstruct open top (22), removably securing deployable front carrier (26) in compartment (16), but leaving handle (34) of carrier (26) exposed as further described herein. Compartment (16) may be a fixed size, or may be expandable by unzipping side zippers (96) and/or by other means.

Compartment (16) also has a plurality of sealing eyelets (60) positioned adjacent open top (22) configured to receive distal end (48) of cord (44) in alternating series after passing through opening (58). Specifically, sealing eyelets (60) are configured to allow distal end (48) of cord (44) to pass first through sealing eyelet (60*a*) at back side (20*a*) of compartment (16), next through sealing eyelet (60*b*) at front side (18*a*) of compartment (16), next through sealing eyelet (60*c*) at back side (20*a*) of compartment (16), etc. Or likewise, distal end (48) of cord (44) could pass first through a sealing eyelet (60) at front side (18*a*) of compartment (16), next through a sealing eyelet (60) at back side (20*a*) of compartment (16), next through a sealing eyelet (60) at front side (18*a*) of compartment (16), etc. Compartment (16) also has anchor eyelets (62L) and (62R) positioned therein configured to receive and removably secure/anchor distal end (48) of cord (44) after passing through sealing eyelets (60) in alternating series (either left to right (62R) or right to left (62L)). In one embodiment in which only one shoulder harness (24) has a channel (52), compartment (16) has only one anchor eyelet (62) which is located at a side of backpack (10) opposite the channel (52).

Sealing eyelets (60) and anchor eyelets (62) may be loops formed of nylon, plastic, elastic, and/or other material, and may be biased to a closed/constricted position, requiring only slight squeezing pressure (e.g., between a thumb and forefinger) to temporarily force and hold open thus allowing distal end (48) of cord (44) to pass therethrough, after which once the pressure is removed, cord (44) is removably retained therein by slight frictional forces. Sealing eyelets (60) may be on flaps (72), (74) atop front wall (18) and back wall (20) respectively along open top (22) of compartment (16), and in one embodiment sealing eyelets (60) on flap (72) of front wall (18) are on underside (72*u*) of front wall (18), and sealing eyelets (60) on flap (74) of back wall (20) are on overside (74*o*) of back wall (20), as best seen in FIG. 6. This allows front flap (72) to be folded over back flap (74) such that underside (72*u*) of front flap (72) covers overside (74*o*) of back flap (74) to at least partially conceal sealing eyelets (60), subject to handle (34) extending out of compartment (16).

In an embodiment (not shown) with exactly two sealing eyelets (60), one sealing eyelet (60) is positioned on underside (72*u*) of front flap (72), and the other sealing eyelet (60) is positioned on the overside (74*o*) of back flap (74). In an embodiment with exactly three sealing eyelets (60*a*), (60*b*), and (60*c*), as best seen in FIG. 6, one sealing eyelet (60*b*) is positioned on underside (72*u*) of front flap (72), and two sealing eyelets (60*a*) and (60*c*) are positioned on overside (74*o*) of back flap (74). In this embodiment, sealing eyelets (60*a*), (60*b*), (60*c*) are positioned such that when front flap (72) is folded over back flap (74) as described herein, sealing eyelet (60*b*) is thus positioned between sealing eyelets (60*a*) and (60*c*).

Turning back to shoulder harnesses (24), at least one harness (24) has a channel (52) along a length thereof for receiving, removably securing, and guiding cord (44) therethrough as further described herein. In some embodiments, both harnesses (24L) and (24R) have channels (52L) and (52R) respectively to allow backpack (10) to be prepared with ripcord (42) positioned along the left shoulder harness (24L) or right shoulder harness (24R) as desired. Channel (52) may be created by sewing canvas, nylon, cloth, or other material along a length of shoulder harness (24) leaving an open entry point (54) at a lower portion thereof and an open exit point (56) at an upper portion thereof. Channel (52) may also be a rubber, plastic, metal, or other tube or structure capable of receiving, removably securing, and guiding cord (44) therethrough as described herein. At least one harness (24) may also have hook and loop surface (40) thereon complimentary to hook and loop surface (38) of adjustable portion (34*b*) of handle (34), so that such surfaces (40) and (38) may be used to removably secure the distal end of adjustable portion (34*b*) of handle (34) to shoulder harness (24).

Figure 5:
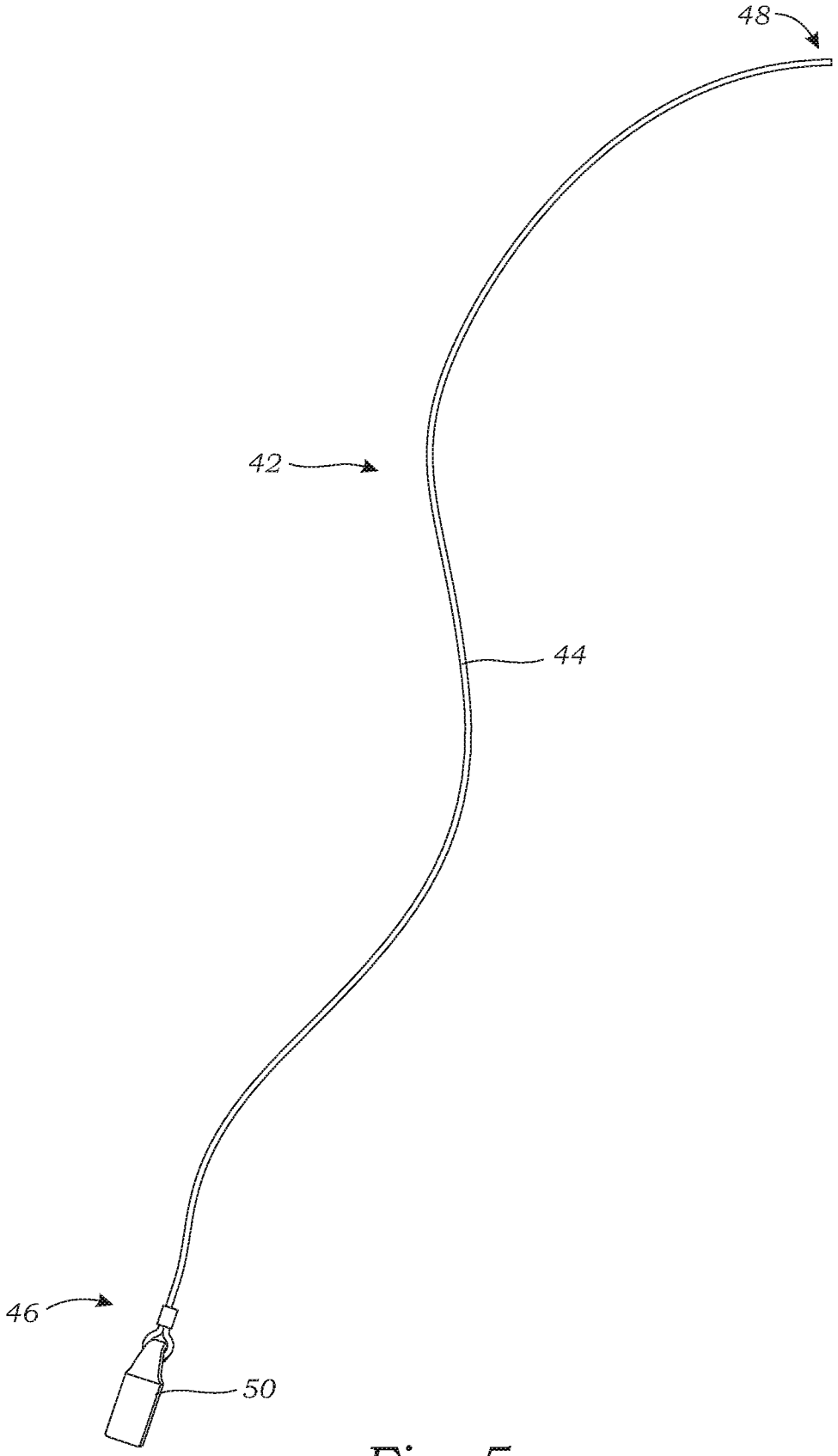
FIG. 5 shows a ripcord (42) in accordance with an embodiment of the present invention.
Figure 7:
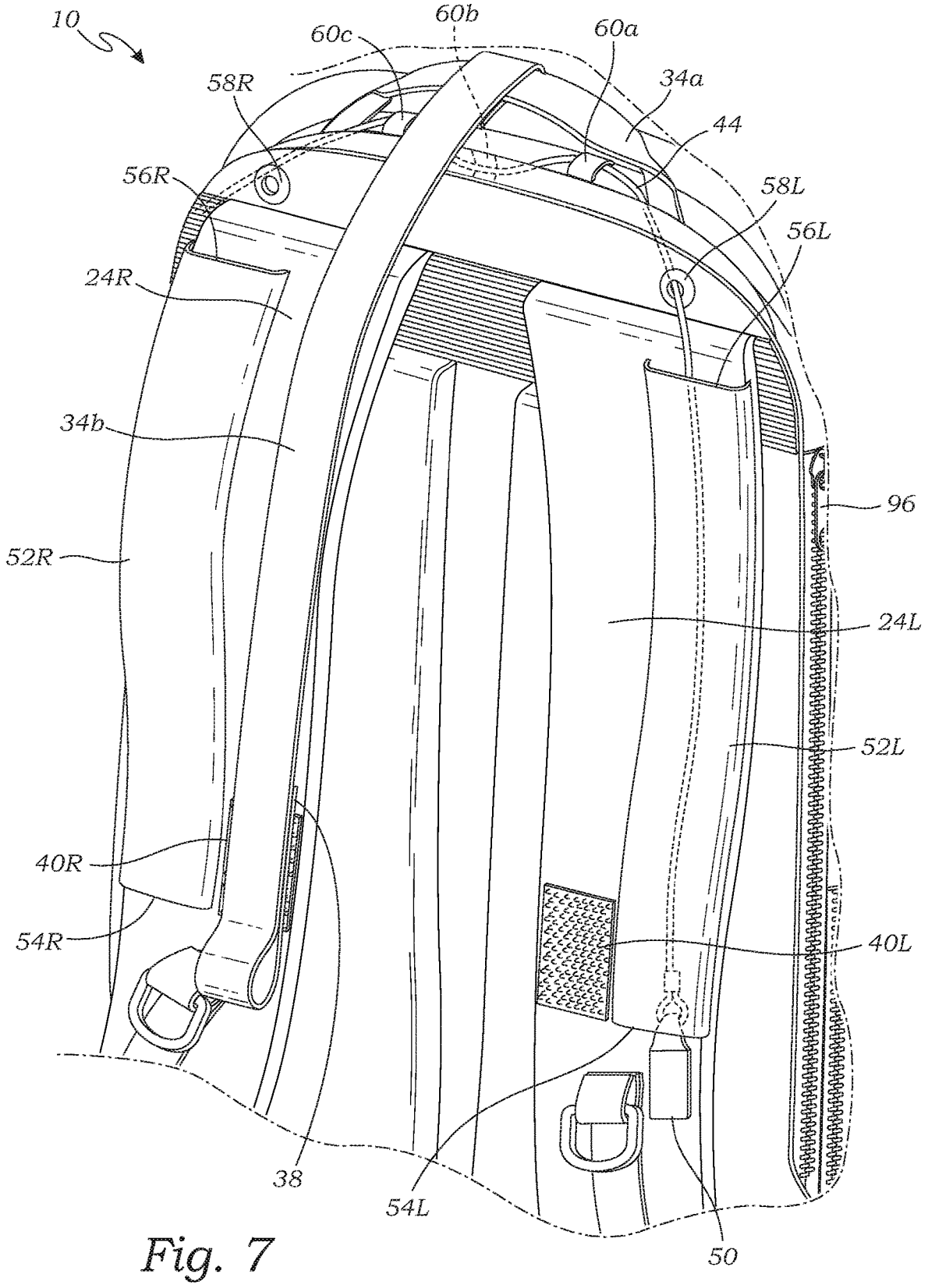
FIG. 7 shows the backpack (10) of FIG. 6 with the ripcord (42) tightened and the front flap (72) folded over back flap (74).

FIG. 5 shows a ripcord (42) in accordance with an embodiment of the present invention. Ripcord (42) includes cord (44) having proximal end (46) with pull tab (50), and distal end (48). Cord (44) may be twisted wire, wood, hard rubber, plastic, coated wire, or any material(s) sturdy enough to be threaded through the sealing path as best seen in FIG. 6. The sealing path is configured such that cord (44) may be threaded therethrough left to right (from channel (52L) on left shoulder harness (24L), to opening (58L), to sealing eyelets (60), to anchor eyelet (62R) on opposite side of backpack (10)) or right to left (from channel (52R) on right shoulder harness (24R), to opening (58R), to sealing eyelets (60), to anchor eyelet (62L) on opposite side of backpack (10)). In either case, ripcord (42) partially obstructs open top (22) to removably secure deployable front carrier (26) in compartment (16), as best seen in FIGS. 6-7.

Figure 8:
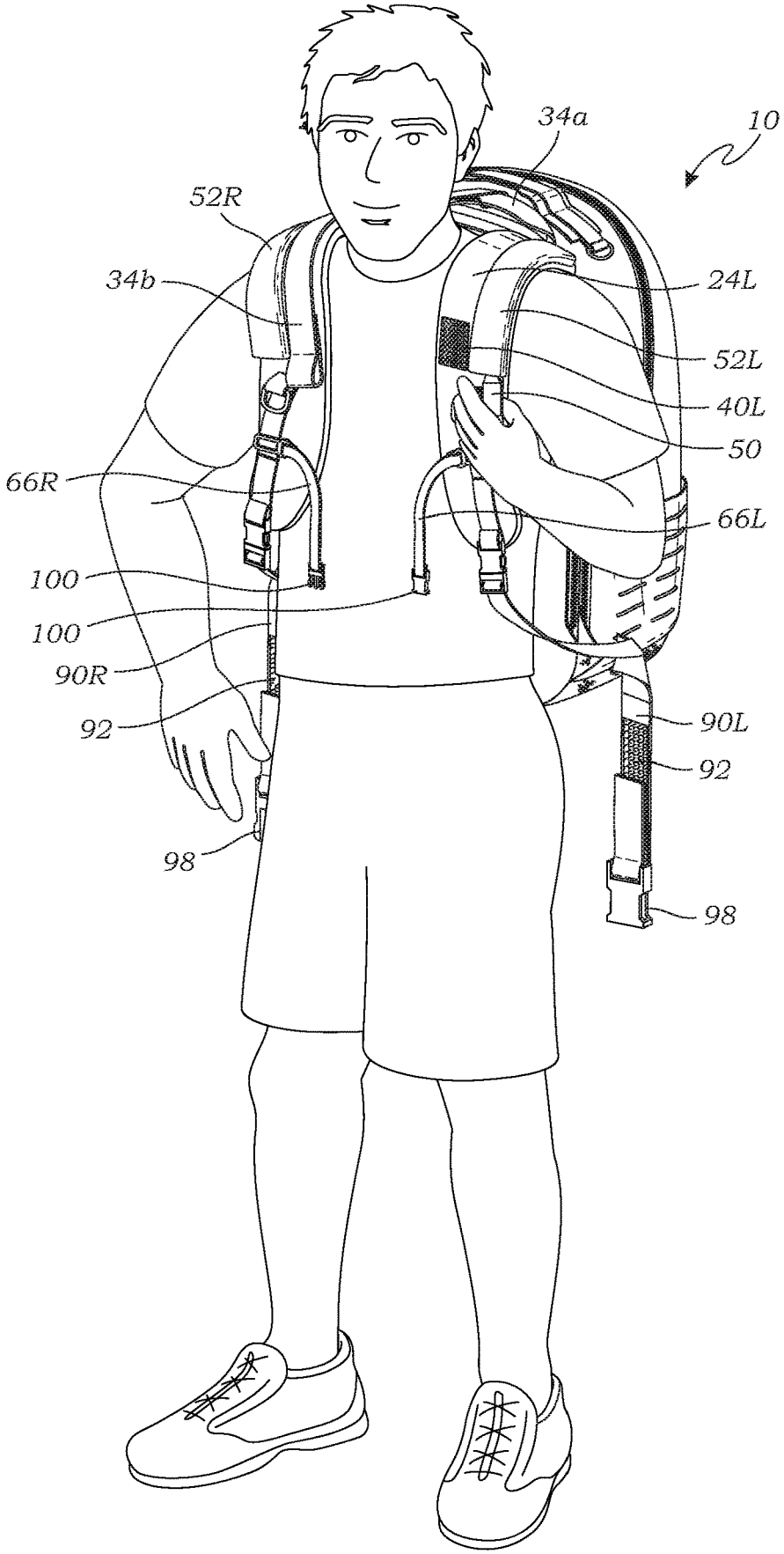
FIG. 8 shows the backpack (10) of FIG. 7 being worn by a person, with the deployable front carrier (26) removably secured in the compartment (16).

Using the first example from left to right, to prepare backpack (10) for use, once deployable front ballistic carrier (26) (containing ballistic armor (64)) is placed in compartment (16), distal end (48) of cord (44) is threaded (by pushing, pulling, guiding, etc.) through sealing path by first inserting distal end (48) of cord (44) into entry point (54L) of channel (52L). Distal end (48) of cord (44) is then threaded through channel (52L) until exiting at exit point (56L) of channel (52L). Distal end (48) of cord (44) is then threaded through opening (58L) in front wall (18) of compartment (16), then through sealing eyelets (60) in alternating series (i.e., from front to back to front to back . . . or from back to front to back to front . . . depending on the quantity and orientation of sealing eyelets (60)). In this manner, an additional length of cord (44) passes through channel (52L). Distal end (48) of cord (44) is then inserted into anchor eyelet (62R) on opposite side of backpack (10), and pushed in far enough to cause pull tab (50) of ripcord (42) to abut up against and rest adjacent entry point (54L) of channel (52L) as best seen in FIG. 8. In embodiments having flaps (72), (74), front flap (72) may be folded down to partially conceal cord (44).

Figure 9:
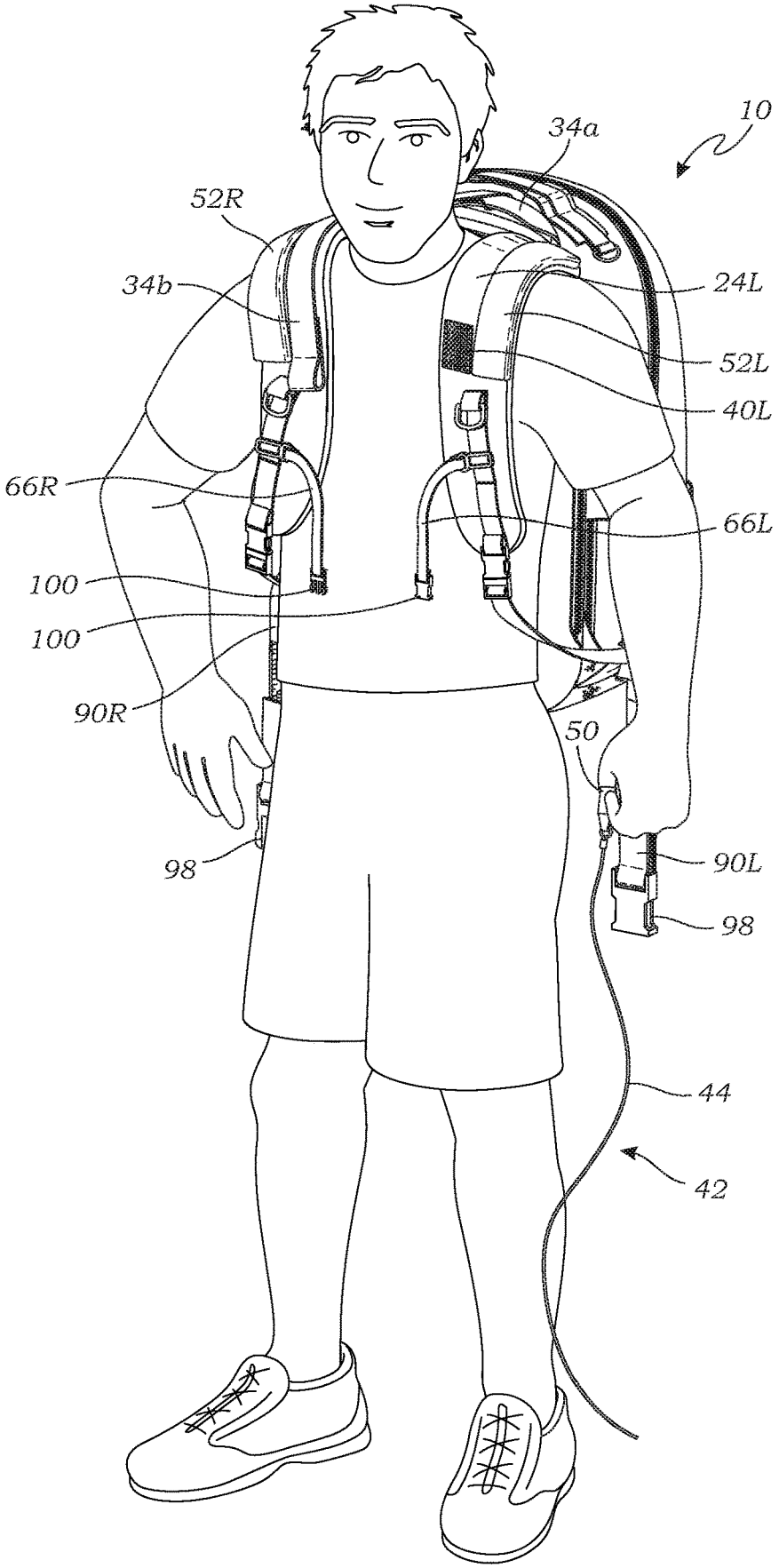
FIG. 9 shows the backpack (10) of FIG. 8 on the person, with the ripcord (42) pulled out.

Typically pull tab (50) is dimensioned such that it can not be pulled through channel (52L). This can be accomplished using a stopper (not shown) such as a disk, ball, pin, etc. attached to pull tab (50), or simply by dimensioning pull tab (50) not to fit in channel (52L). In use, pull tab (50) is pulled to cause distal end (48) of cord (44) to disengage from anchor eyelet (62R) and traverse back through sealing eyelets (60) such that open top (22) becomes unobstructed, as best seen in FIG. 9. Often, cord (44) will be pulled with such force to cause distal end (48) of cord (44) to further pass back through opening (58L), exit point (56L), channel (52L), and entry point (54L), such that ripcord (42) is completely disengaged from backpack (10). The amount of force required in either case should be quite minimal, similar to pulling a chain on a ceiling fan to activate the fan.

Referring back now to FIGS. 1-4, deployable front carrier (26) has body (32), handle (34), and left and right shoulder straps (28L), (28R) respectively. In some embodiments, carrier (26) has edge pouch (76) to help contain ballistic armor (64). Body (32) of carrier (26) is configured to carry ballistic armor (64), which may be soft or hard ballistic armor. Body (32) may have a MOLLE ("Modular Lightweight Load-carrying Equipment") or similar front face (36), and/or hook and loop surfaces (88) for mating with complimentary hook and loop surfaces (92), (94) on waist strap (90) and chest strap (66) respectively.

Handle (34) may be any handle suitable for quick and easy deployment of front carrier (26). In the embodiment shown in the drawings, handle (34) has fixed portion (34*a*) and adjustable portion (34*b*). Fixed portion (34*a*) is a loop handle fixedly attached to body (32), and adjustable portion (34*b*) is a strap adjustably attached to fixed portion (34*a*) such that the adjustable portion (34*b*) is slideable back and forth along fixed portion (34*a*). This allows adjustable portion (strap) (34*b*) to be positioned left or right of center as needed when preparing backpack (10) for use as described herein, depending on whether the person wearing backpack (10) prefers to pull strap (34*b*) from his/her left or right shoulder. Strap (34*b*) is configured to extend out from open top (22) when open top (22) is partially obstructed by cord portion (44) of ripcord (42) while backpack (10) is in use. This way, adjustable portion (34*b*) may lay over a shoulder of the person wearing backpack (10) and extend along the corresponding shoulder harness (24) of backpack (10). Further, strap (34*b*) may have hook and loop surface (38) complimentary to hook and loop surfaces (40) on the backpack's shoulder harnesses (24), such that adjustable portion (34*b*) may be removably attached to shoulder harness (24) thereby. Typically, hook and loop surface (38) will be at or near the terminal/distal end of strap (34*b*).

Shoulder straps (28) of deployable front ballistic carrier (26) are attached at one end to one of walls (18), (20) of compartment (16) inside compartment (16), and at the other end to body (32) of carrier (26). Typically they are attached to back wall (20) as seen in FIG. 2 at attachment points (30), by reinforced stitching and/or heat welding. Shoulder straps (28) comprise elastic and may also include FASTEX or similar buckles and/or hook and loop surfaces to allow for further adjustment. As such, shoulder straps (28) have adjustable lengths and may thus accommodate various human body sizes.

Figure 13:
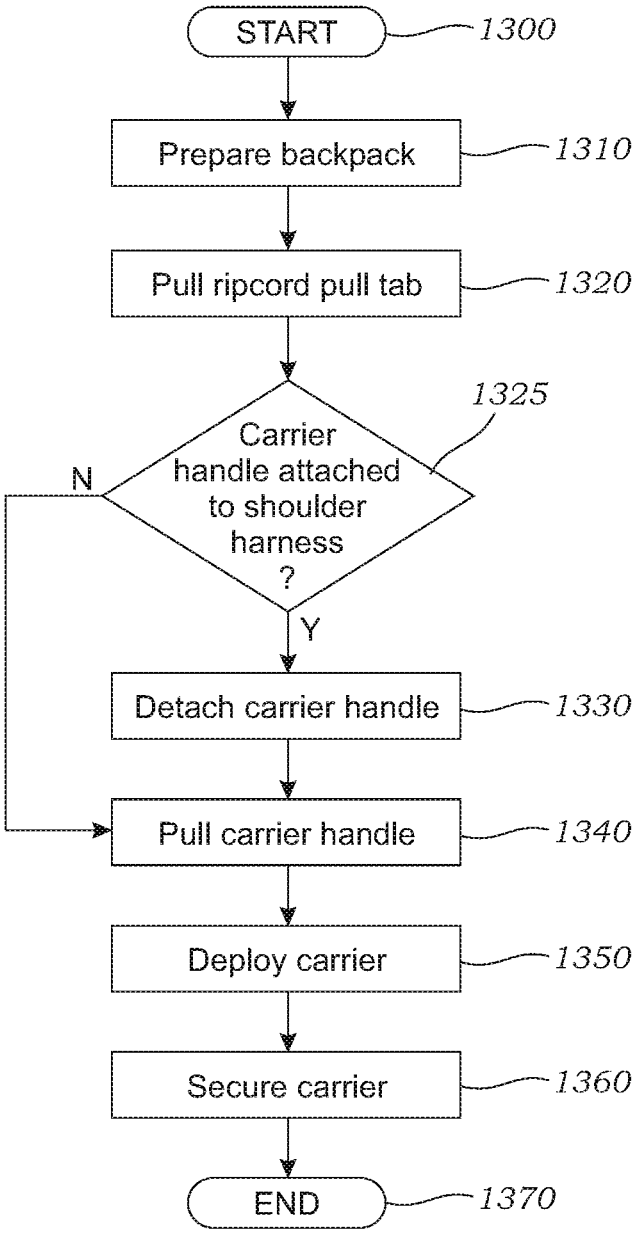
FIG. 13 shows a flowchart illustrating a method of deploying a front carrier from a backpack in accordance with an embodiment of the present invention.

Methods of using a backpack (10) in accordance with embodiments of the present invention will now be described with primary reference to FIG. 13. The method begins at Step 1300. At Step 1310, backpack (10) of the present invention is then prepared for use. This includes inserting or otherwise placing deployable front carrier (26) (containing ballistic armor (64)) in compartment (16), with handle (34) being exposed through open top (22), then threading ripcord (42) through sealing path as described herein (e.g., through channel (52L), opening (58L), sealing eyelets (60) in alternating series, then into anchor eyelet (62R)) such that open top (22) of compartment (16) is partially obstructed by ripcord (42), and pull tab (50) from ripcord (42) rests adjacent entry point (54L) of channel (52L). Preparing backpack (10) may also include removably attaching distal end of adjustable portion (34*b*) of handle (34) to opposite shoulder harness (24), e.g., using complimentary hook and loop surfaces (38) and (40). Finally, preparing backpack (10) includes wearing backpack (10) as seen in FIG. 8. When Step 1310 is complete, backpack (10) is ready for use as best seen in FIG. 8. Of course, simply having backpack (10) ready for use in such a configuration on a person's back would suffice to satisfy this "preparing" Step 1310.

When it comes time to deploy front carrier (26), the person wearing backpack (10) pulls tab (50) of ripcord (42) to disengage distal end (48) of cord (44) from anchor eyelet (62) and traverse cord (44) back through sealing eyelets (60) such that open top (22) becomes unobstructed. This is done at Step 1320. In most instances, pull tab (50) will be pulled with enough force to also pull cord (44) through opening (58L) in wall (18), then through channel (52L) (from exit point (56L) to entry point (54L)), such that ripcord (42) is completely disengaged from backpack (10), as seen in FIGS. 9-12.

After disengaging cord (44) from eyelets (62), (60) (and from backpack (10) if applicable), then if carrier handle (34) is attached to shoulder harness (24R), carrier handle is detached. This is shown at Steps 1325 and 1330. If carrier handle (34) is not attached to shoulder harness (24R), then Step 1330 is not applicable, and is thus bypassed. Further, Step 1330 could be performed before Step 1320 if desired.

As described herein, and best seen in FIG. 8, typically if carrier handle (34) is attached to a shoulder harness (24), it is attached to the harness (24) opposite where ripcord (42) is inserted through channel (52). In this example, since ripcord (42) is in channel (52L) of left shoulder harness (24L), carrier handle (34) is attached to shoulder harness (24R). Specifically in this example, handle (34) has fixed portion (34*a*) and adjustable portion (34*b*). Fixed portion (34*a*) is an arch fixedly attached at either end to body (32) of front carrier (26). Adjustable portion (34*b*) is a strap adjustably attached to fixed portion (34*a*). In some embodiments, as best seen in FIGS. 1-3, strap (34*b*) is slidingly attached to fixed portion (34*a*). This allows the strap (34*b*) to be positioned left or right of center as needed, to extend along a corresponding shoulder harness (24), and to be attached to such harness (24) if applicable, depending on whether the person wearing backpack (10) prefers to pull strap (34*b*) from his/her left or right shoulder.

Figure 10:
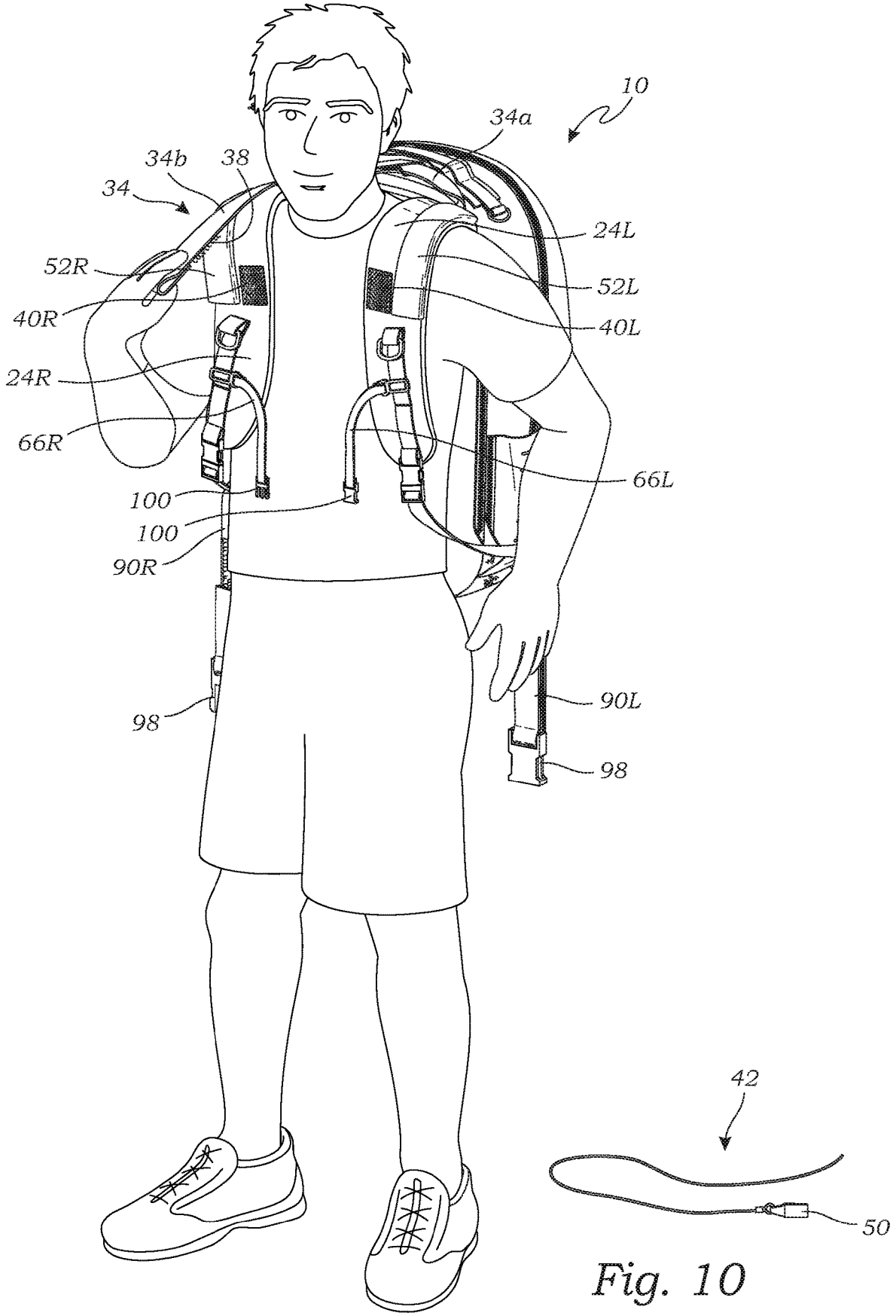
FIG. 10 shows the backpack (10) of FIG. 9 on the person, with the carrier handle (34) being disengaged from the backpack's shoulder harness (24R).
Figure 11:
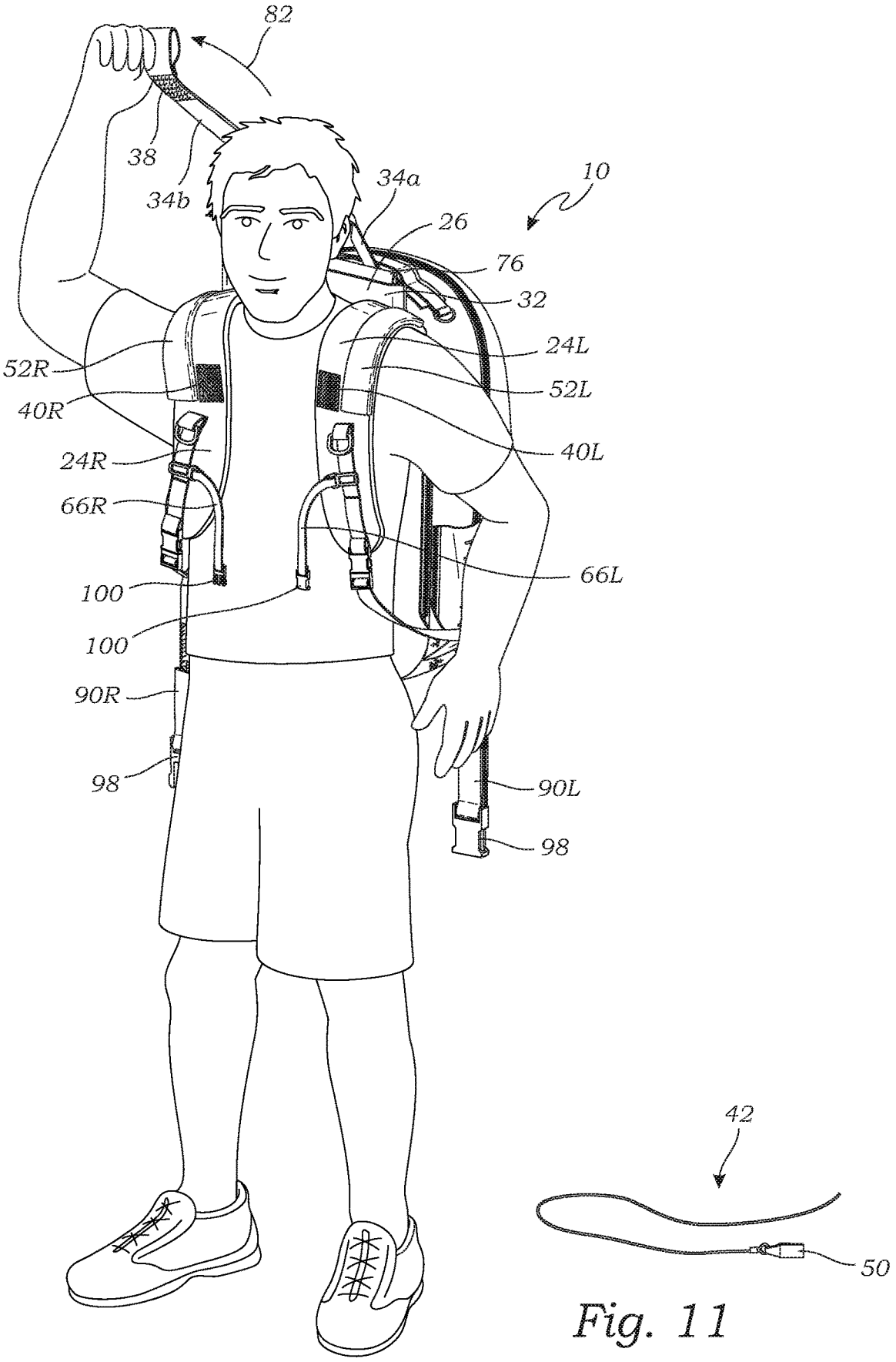
FIG. 11 shows the backpack (10) of FIG. 10 on the person, with the carrier (26) being removed from the compartment (16) and swung of the person's head.

To facilitate attachment of carrier handle (34) to shoulder harness (24R), strap (34*b*) has hook and loop surface (38) on a distal end thereof, and shoulder harness (24R) has hook and loop surface (40R) complimentary to hook and loop surface (38) of strap (34*b*). Handle (34) may thus be removably attached to shoulder harness (24R) by mating hook and loop surface (38) of handle (34) with hook and loop surface (40R) of shoulder harness (24R). To detach carrier handle (34) from shoulder harness (24R) in this embodiment, distal end of carrier handle (34) is ripped or peeled away from shoulder harness (24R) to disengage hook and loop surfaces (38) and (40R), as seen in FIG. 10.

Figure 12:
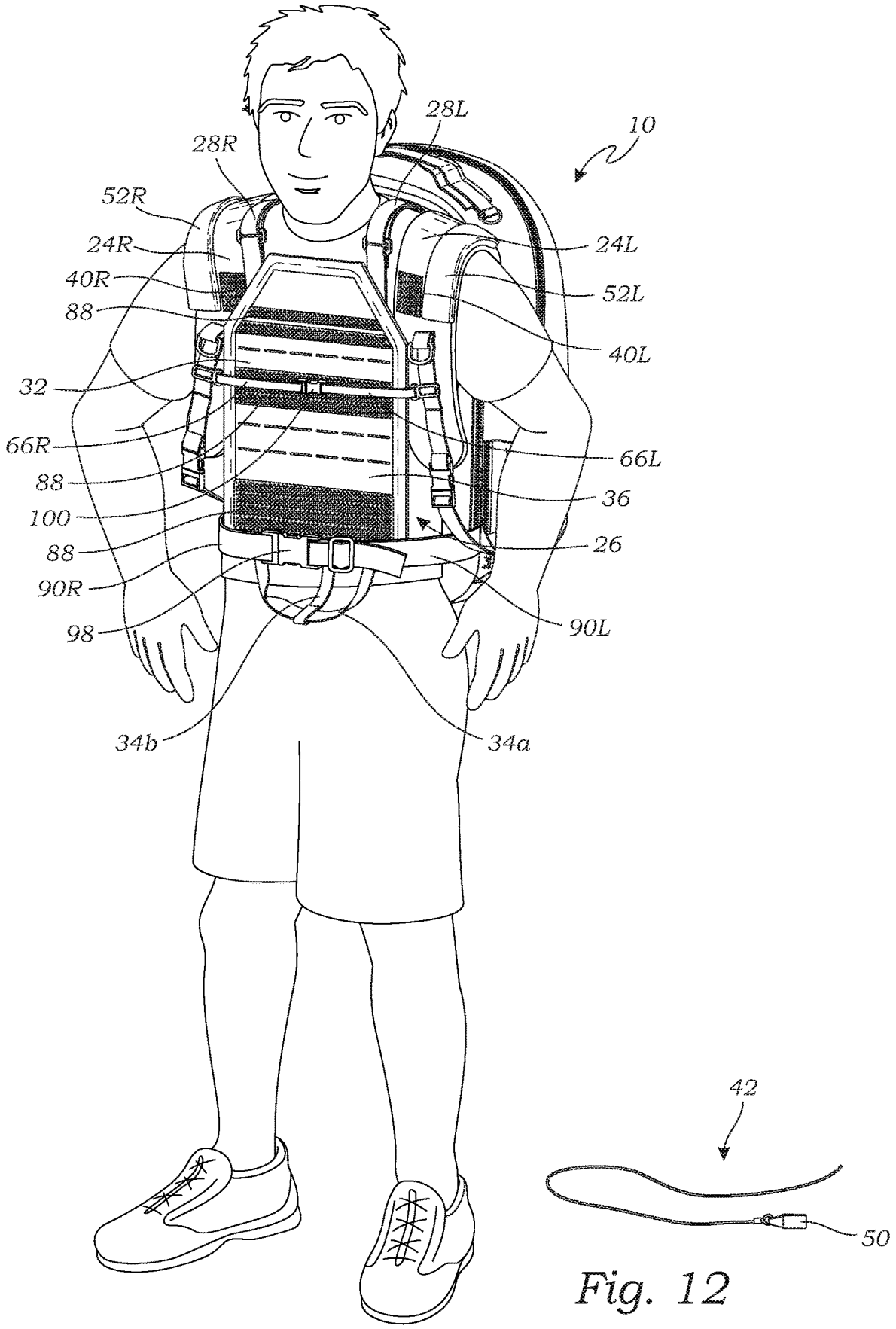
FIG. 12 shows the backpack (10) of FIG. 11 on the person, with the carrier (26) fully deployed over the person's chest area, and further secured by a waist strap (90) and a chest strap (66).

Once carrier handle (34) is detached from shoulder harness (24R), either at Step 1330 or because it was not attached in the first instance as represented by the "N" branch at Step 1325, carrier handle (34) is then pulled at Step 1340 to remove front carrier (26) from compartment (16). Typically carrier handle (34) is pulled initially straight out of compartment (16) overhead as indicated by directional arrow (82) in FIG. 11. Carrier (26) is then deployed over the head of the person wearing backpack (10) at Step 1350 such that left and right shoulder straps (28L), (28R) rest over the left and right shoulders of the person respectively, and front carrier (26) rests against chest area of the person. This Step 1350 may be accomplished by pulling carrier handle (34) hand-over-hand until carrier (26) is over the person's shoulders oriented as front armor covering the person's chest area, as seen in FIG. 12. This Step 1350 may also be accomplished by simply swinging carrier (26) over the person's shoulders.

After carrier (26) (with ballistic armor (64)) is deployed, carrier (26) may be further secured to person at Step 1360 by using waist strap (90) and/or chest strap (66). Waist strap (90) may comprise elastic, FASTEX-type buckles (98), and/or hook and loop surfaces (92) for flexibility to accommodate various body shapes and sizes. Likewise, chest strap (66) may comprise elastic, FASTEX-type buckles (100), and/or hook and loop surfaces (94). In some embodiments, waist strap (90) includes left portion (90L) and right portion (90R) fixedly attached to left and right sides of backpack (10) respectively. Likewise, chest strap (66) includes left portion (66L) and right portion (66R) fixedly attached to left and right sides of backpack (10) respectively. In embodiments in which waist strap (90) and/or chest strap (66) include hook and loop surfaces (92) and/or (94) respectively, such surfaces would be complimentary to hook and loop surface (88) on front face (36) of body (32) of carrier (26).

The method then ends at Step 1370. In embodiments with ballistic armor (68) in main compartment (12), person would then be protected by both front armor (64) and back armor (68).

A backpack (10) with a rapid-deploy front ballistic carrier (26) has thus been described, along with methods of use.

What is claimed is:

1. A backpack comprising:

a first compartment;

a second compartment having a front wall at a front side, a back wall at a back side, and an open top;

right and left shoulder harnesses; and a deployable ballistic carrier having a) a body, b) a handle, and c) right and left shoulder straps attached to one of the walls of the second compartment inside the second compartment;

wherein the deployable ballistic carrier is configured to be removably secured in the second compartment by a retention system such that the handle is exposed through the open top;

wherein the retention system comprises:

a ripcord having a proximal end and a distal end, and a pull tab at the proximal end;

a channel along a length of one of the right and left shoulder harnesses having an entry point at a lower portion and an exit point at an upper portion, configured to allow the distal end of the cord to enter at the entry point, pass therethrough, and exit at the exit point, and to allow an additional length of the cord to then pass therethrough until the pull tab abuts up against the entry point and remains outside of the channel;

an opening in the front wall of the second compartment adjacent the exit point of the channel and configured to allow the distal end of the cord to pass therethrough after passing through the exit point of the channel;

a plurality of sealing eyelets positioned adjacent the open top of the second compartment configured to receive the distal end of the cord in alternating series after passing through the opening in the front wall of the second compartment, comprising a first sealing eyelet positioned at the front side of the second compartment, and a second sealing eyelet positioned at the back side of the second compartment; and an anchor eyelet positioned in the second compartment at a side of the backpack opposite the channel, and configured to receive and removably anchor the distal end of the cord after passing through the sealing eyelets in alternating series; and wherein the retention system is configured such that when the distal end of the cord is threaded along a path from the entry point of the channel, through the channel, through the exit point of the channel, through the opening in the front wall, through the plurality of sealing eyelets in alternating series, and into the anchor eyelet, the cord removably secures the deployable ballistic carrier in the second compartment by partially obstructing the open top, the pull tab rests adjacent the entry point of the channel on the corresponding shoulder harness, and the pull tab is configured such that pulling the pull tab causes the distal end of the cord to disengage from the anchor eyelet and traverse back through the sealing eyelets such that the open top becomes unobstructed.

2. The backpack of claim 1, further comprising a ballistic armor in the deployable ballistic carrier.

3. The backpack of claim 2, further comprising a ballistic armor removably secured in the first compartment.

4. The backpack of claim 1, further comprising a front flap atop the front wall of the second compartment along the open top, and a back flap atop the back wall of the second compartment along the open top, and wherein the first sealing eyelet is positioned on the front flap and the second sealing eyelet is positioned on the back flap.

5. The backpack of claim 4, wherein:

the plurality of sealing eyelets further comprises a third sealing eyelet positioned on the back flap;

the first sealing eyelet is positioned on an underside of the front flap;

the second and third sealing eyelets are positioned on an overside of the back flap; and the first, second, and third sealing eyelets are positioned along the path in the order of the second sealing eyelet, the first sealing eyelet, and the third sealing eyelet.

6. The backpack of claim 1, wherein the retention system further comprises:

a second channel along a length of the other of the right and left shoulder harnesses having a second entry point at a lower portion thereof and a second exit point at an upper portion thereof, configured to allow the distal end of the cord to enter at the second entry point, pass therethrough, and exit at the second exit point, and to allow the additional length of the cord to then pass therethrough until the pull tab abuts up against the second entry point and remains outside of the second channel;

a second opening in the front wall of the second compartment adjacent the second exit point and configured to allow the distal end of the cord to pass therethrough after passing through the second exit point; and a second anchor eyelet positioned in the second compartment at a side of the backpack opposite the second channel, and configured to receive and removably anchor the distal end of the cord after passing through the sealing eyelets in alternating series;

wherein the retention system is further configured such that when the distal end of the cord is threaded along a path from the second entry point, through the second channel, through the second exit point, through the second opening in the front wall, through the plurality of sealing eyelets in alternating series, and into the second anchor eyelet, the cord removably secures the deployable ballistic carrier in the second compartment by partially obstructing the open top, the pull tab is exposed adjacent the second entry point of the second channel on the corresponding shoulder harness, and the pull tab is configured such that pulling the pull tab causes the distal end of the cord to disengage from the second anchor eyelet and traverse back through the sealing eyelets such that the open top becomes unobstructed.

7. The backpack of claim 1, wherein the right and left shoulder straps of the deployable ballistic carrier comprise elastic, have adjustable lengths, and are attached to the back wall of the second compartment inside the second compartment.

8. The backpack of claim 1, wherein the handle of the deployable ballistic carrier comprises a fixed portion and an adjustable portion, the fixed portion being fixedly attached to the body of the deployable ballistic carrier, and the adjustable portion being adjustably attached to the fixed portion.

9. The backpack of claim 8, wherein:

the adjustable portion of the handle is a strap configured to extend out from the open top of the second compartment when the open top is partially obstructed, and to extend along one of the right and left shoulder harnesses;

the adjustable portion of the handle has a hook and loop surface at a distal end thereof; and at least one of the right and left shoulder harnesses has a hook and loop surface complimentary to the hook and loop surface of the adjustable portion of the handle.

10. The backpack of claim 9, wherein the adjustable portion of the handle is slidingly attached to the fixed portion of the handle.

11. The backpack of claim 9, wherein both the right and left shoulder harnesses have hook and loop surfaces complimentary to the hook and loop surface of the handle strap.

12. The backpack of claim 1, further comprising a waist strap.

13. A method of deploying a front carrier from a compartment of a backpack over a chest area of a person wearing the backpack, wherein the compartment has an open top, and the front carrier has a body, a handle, and right and left shoulder straps attached at one end to a wall of the compartment inside the compartment and at the other end to the body of the front carrier, wherein the backpack has a first shoulder harness with a channel thereon, an opening in a wall of the compartment adjacent an exit point of the channel, sealing eyelets positioned adjacent the open top, and an anchor eyelet in the compartment, the method comprising:

preparing the backpack for use by: a) placing the body of the front carrier in the compartment leaving the handle of the front carrier exposed through the open top; and b) threading a ripcord through the channel from an entry point of the channel to the exit point, through the opening in the wall of the compartment, through the sealing eyelets in alternating series, and into the anchor eyelet, such that the open top of the compartment is partially obstructed by the ripcord and a pull tab on the ripcord rests adjacent the entry point of the channel;

pulling the pull tab to disengage the ripcord from the anchor eyelet and traverse the ripcord back through the sealing eyelets such that the open top becomes unobstructed;

pulling the handle of the front carrier to remove the front carrier from the compartment; and deploying the front carrier over the head of the person wearing the backpack such that the right and left shoulder straps rest over the right and left shoulders of the person respectively, and the front carrier rests against the chest of the person.

14. The method of claim 13, wherein the backpack has a second shoulder harness, and wherein the handle of the front carrier has a hook and loop surface on a distal end thereof, and the second shoulder harness has a hook and loop surface complimentary to the hook and loop surface of the handle, and wherein the preparing the backpack for use further comprises removably attaching the handle to the second shoulder harness by mating the hook and loop surface of the handle with the hook and loop surface of the second shoulder harness, the method further comprising: detaching the handle from the second shoulder harness before pulling the handle, by disengaging the hook and loop surface of the handle and the hook and loop surface of the second shoulder harness.

15. The method of claim 14, wherein the ripcord is further pulled back through the opening in the wall, the exit point, the channel, and the entry point, such that the ripcord is completely disengaged from the backpack.

16. The method of claim 14, wherein the handle of the front carrier comprises a fixed portion and an adjustable portion, the fixed portion being fixedly attached to the body of the front carrier, and the adjustable portion being adjustably attached to the fixed portion, and wherein the hook and loop surface on the distal end of the handle is on the adjustable portion.

17. The method of claim 16, wherein the adjustable portion of the handle is a strap configured to extend out from the open top of the compartment when the open top is partially obstructed, and to extend along the second shoulder harnesses.

18. The method of claim 17, wherein the strap of the handle is slidingly attached to the fixed portion of the handle.

19. The method of claim 18, wherein the backpack further comprises a waist strap fixedly attached thereto, and the method further comprises strapping the waist strap around the waist of the person.

20. The method of claim 13, wherein the ripcord is further pulled back through the opening in the wall, the exit point, the channel, and the entry point, such that the ripcord is completely disengaged from the backpack.

* * * * *